US010661587B2

(12) United States Patent
Kanai

(10) Patent No.: US 10,661,587 B2
(45) Date of Patent: May 26, 2020

(54) TEST PATTERN CREATION METHOD, TEST PATTERN, PRINTING APPARATUS, AND PROGRAM

(71) Applicant: SEIKO EPSON CORPORATION, Tokyo (JP)

(72) Inventor: Masashi Kanai, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/899,817

(22) Filed: Feb. 20, 2018

(65) Prior Publication Data

US 2018/0236800 A1 Aug. 23, 2018

(30) Foreign Application Priority Data

Feb. 21, 2017 (JP) ..... 2017-029920

(51) Int. Cl.

| | |
|---|---|
| ***B41J 29/393*** | (2006.01) |
| ***B41J 2/14*** | (2006.01) |
| ***B41J 2/155*** | (2006.01) |
| ***B41J 2/21*** | (2006.01) |
| ***B41J 2/045*** | (2006.01) |

(52) U.S. Cl.

CPC ..... *B41J 29/393* (2013.01); *B41J 2/04505* (2013.01); *B41J 2/04586* (2013.01); *B41J 2/1433* (2013.01); *B41J 2/155* (2013.01); *B41J 2/2103* (2013.01); *B41J 2/2135* (2013.01); *B41J 2/2142* (2013.01); *B41J 2029/3935* (2013.01)

(58) Field of Classification Search

None

See application file for complete search history.

(56) References Cited

U.S. PATENT DOCUMENTS

| | | | | |
|---|---|---|---|---|
| 6,334,720 | B1 * | 1/2002 | Kato | B41J 19/145 400/118.2 |
| 7,324,131 | B2 * | 1/2008 | Liebig | B41C 1/1083 347/240 |
| 2007/0008370 | A1 | 1/2007 | Kawatoko et al. | |
| 2007/0296752 | A1 | 12/2007 | Maruo et al. | |
| 2011/0001778 | A1 | 1/2011 | Kanda et al. | |

FOREIGN PATENT DOCUMENTS

| | | | |
|---|---|---|---|
| JP | 2007-015269 | A | 1/2007 |
| JP | 2008-001053 | A | 1/2008 |
| JP | 2010-000665 | A | 1/2010 |
| JP | 2011-011464 | A | 1/2011 |
| JP | 2011-194654 | A | 10/2011 |

* cited by examiner

*Primary Examiner* — Alejandro Valencia

(74) *Attorney, Agent, or Firm* — Foley & Lardner LLP

(57) ABSTRACT

A method for creating a test pattern includes creating a reference ruled line set by ejecting ink from a nozzle formed in a first print tip among a plurality of print tips, and creating a measurement ruled line set by ejecting ink from a nozzle formed in a second print tip among the plurality of print tips. A ruled line in the reference ruled line set and a ruled line in the measurement ruled line set whose positions align in a secondary scan direction when no impact displacement is present in the secondary scan direction are designated as specified ruled lines. The test pattern is created such that spacings between the ruled lines within the reference ruled line set and spacings between the ruled lines within the measurement ruled line set increase on progression in the secondary scan direction away from the specified ruled lines.

6 Claims, 10 Drawing Sheets

TEST PATTERN CREATION METHOD, TEST PATTERN, PRINTING APPARATUS, AND PROGRAM

BACKGROUND

1. Technical Field

The present disclosure relates to a printing test pattern.

2. Related Art

JP-A-2008-001053 describes creating a test pattern in order to detect misalignment in landing positions.

From a cost perspective, test patterns preferably use a small area for printing. However, when a test pattern is printed tightly packed in order to reduce the area, impact displacement becomes difficult to measure.

SUMMARY

An advantage of some aspects of the present disclosure is that measurement of impact displacement is facilitated even when a test pattern is printed tightly packed.

One aspect of the present disclosure is a test pattern creation method including creating a test pattern to measure impact displacement in a secondary scan direction by scanning a carriage including plural print tips in a primary scan direction to create the test pattern so as to include a reference ruled line set including plural reference ruled lines running in the primary scan direction and a measurement ruled line set including plural measurement ruled lines running in the primary scan direction. The test pattern creation method also includes creating the reference ruled line set by ejecting ink from a nozzle formed in a first print tip among the plural print tips, and creating the measurement ruled line set by ejecting ink from a nozzle formed in a second print tip among the plural print tips. A ruled line in the reference ruled line set and a ruled line in the measurement ruled line set whose positions would align in the secondary scan direction were no impact displacement to be present in the secondary scan direction are taken as specified ruled lines. The test pattern is created such that spacings between the ruled lines within the reference ruled line set and spacings between the ruled lines within the measurement ruled line set increase on progression in the secondary scan direction away from the specified ruled lines.

This aspect facilitates measurement of impact displacement even when a test pattern is printed tightly packed. This is since the spacings between the ruled lines in the reference ruled line set and the measurement ruled line set increase on progression in the secondary scan direction away from the specified ruled lines, thereby facilitating determination of which of the impact displacement amount ruled lines are aligned.

In the above aspect, configuration is preferably made wherein the first print tip is provided to a first print head that forms dots of a first ink color, and the second print tip is provided to a second print head that forms dots of a second ink color. This enables creation of a test pattern to measure impact displacement arising as a result of head misalignment between the print heads.

In the above aspect, configuration is preferably made wherein the reference ruled line set configures a first reference ruled line set, the measurement ruled line set configures a first measurement ruled line set, and the specified ruled lines configure first specified ruled lines. The test pattern creation method preferably further includes creating a second reference ruled line set using the first print tip, and creating a second measurement ruled line set by ejecting ink from a nozzle formed in a third print tip mounted to the first print head. Moreover, a ruled line in the second reference ruled line set and a ruled line in the second measurement ruled line set whose positions would align in the secondary scan direction were no impact displacement to be present in the secondary scan direction are taken as second specified ruled lines, and the test pattern is created such that spacings between the ruled lines within the second reference ruled line set, and spacings between the ruled lines within the second measurement ruled line set increase on progression away from the second specified ruled lines. This enables creation of a test pattern to measure impact displacement arising to tip misalignment between the print tips.

In the above aspect, configuration is preferably made wherein the first reference ruled line set is formed at a different position in the secondary scan direction than the position of the second reference ruled line set, and the first measurement ruled line set is formed at a different position in the secondary scan direction than the position of the second measurement ruled line set. This enables the first and second reference ruled line sets and the first and second measurement ruled line sets to be created by a single primary scan.

In the above aspect, configuration is preferably made wherein the test pattern includes at least two ruled line set pairs in which the reference ruled line set and the measurement ruled line set are created using print tips mounted to different print heads. The test pattern creation method preferably further includes forming the measurement ruled line set within a different pair to the pair containing the measurement ruled line set created using the second print tip by using a print tip mounted to a third print head that forms dots in a third ink color. Moreover, a usage frequency of the first ink color is preferably lower than both a usage frequency of the second ink color and a usage frequency of the third ink color. This enables the plural reference ruled line sets to be created using an ink color that is used infrequently.

In the above aspect, configuration is preferably made wherein the first print tip and the second print tip are provided on the same print head. This enables the creation of a test pattern to measure impact displacement arising as a result of tip misalignment between the print tips.

The present disclosure may be implemented by various aspects other than the above. For example, the present disclosure may be implemented by the above test pattern, by a printing apparatus that implements the above creation method, a program that implements the above method, a non-transient storage medium stored with the aforementioned program, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
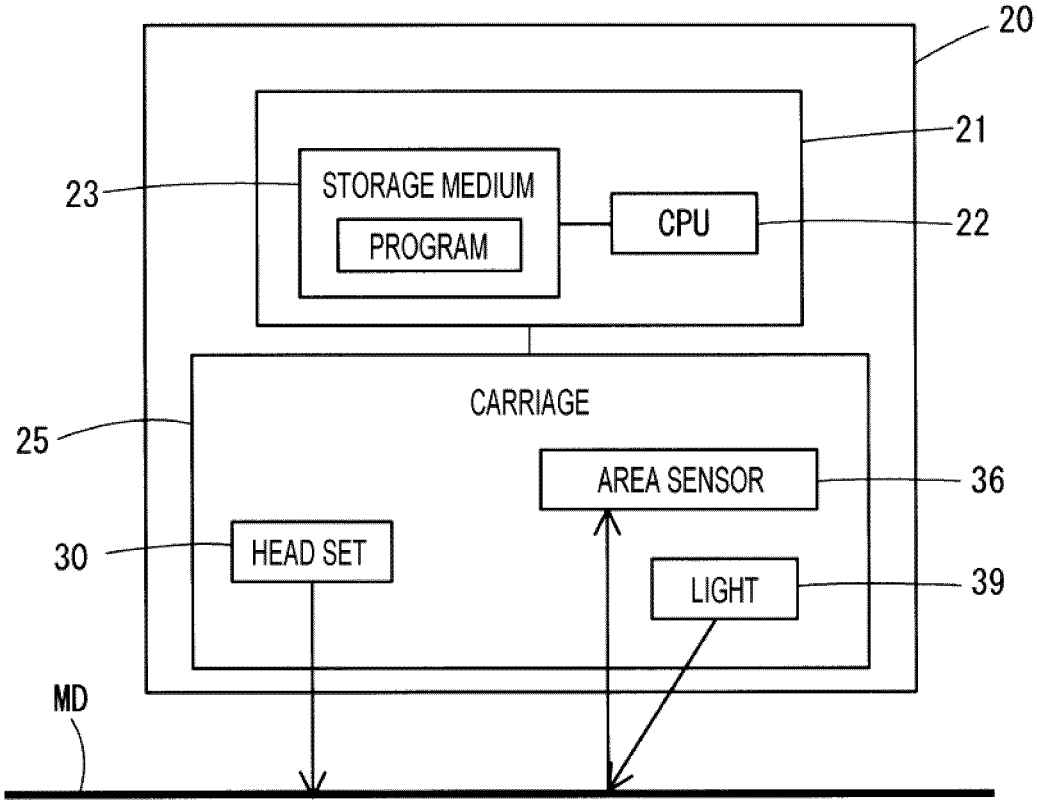
FIG. 1 is a functional block diagram of a printing apparatus.

FIG. 1 is a functional block diagram of a printing apparatus 20. The printing apparatus 20 includes a controller 21 and a carriage 25. The controller 21 includes a CPU 22 and a storage medium 23. The carriage 25 includes a print head set 30, an area sensor 36, and a light 39.

The printing apparatus 20 ejects ink toward a printed medium MD, thereby forming dots on the printed medium MD. The printing apparatus 20 ejects six colors of ink. The six colors are CMYKLcLm, namely cyan, magenta, yellow, black, light cyan, and light magenta. The carriage 25 of the printing apparatus 20 scans in a primary scan direction in order to form the dots, and the printed medium MD is transported in a secondary scan direction.

The area sensor 36 measures radiance values of the printed medium MD. The light 39 illuminates light toward a measurement range of the area sensor 36. The measurements taken by the area sensor 36 are employed in impact displacement amount measurement processing, described later.

The dot formation and radiance value measurements mentioned above are controlled by the CPU 22. The storage medium 23 is stored with a program used to implement printing processing, described later. The printing processing is processing to form the aforementioned dots and measure the radiance values.

Figure 2:
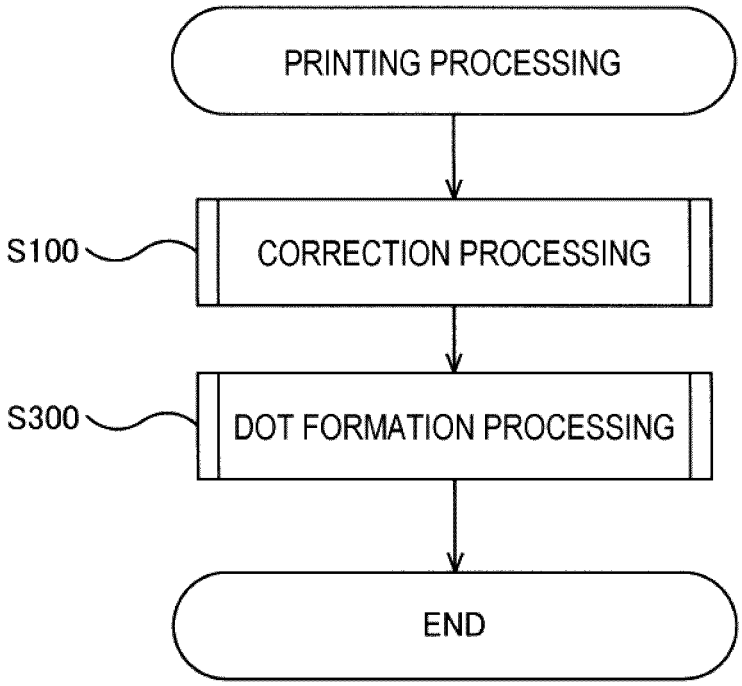
FIG. 2 is a flowchart illustrating printing processing.

FIG. 2 is a flowchart illustrating the printing processing. Correction processing (S100) is executed after starting the printing processing.

Figure 3:
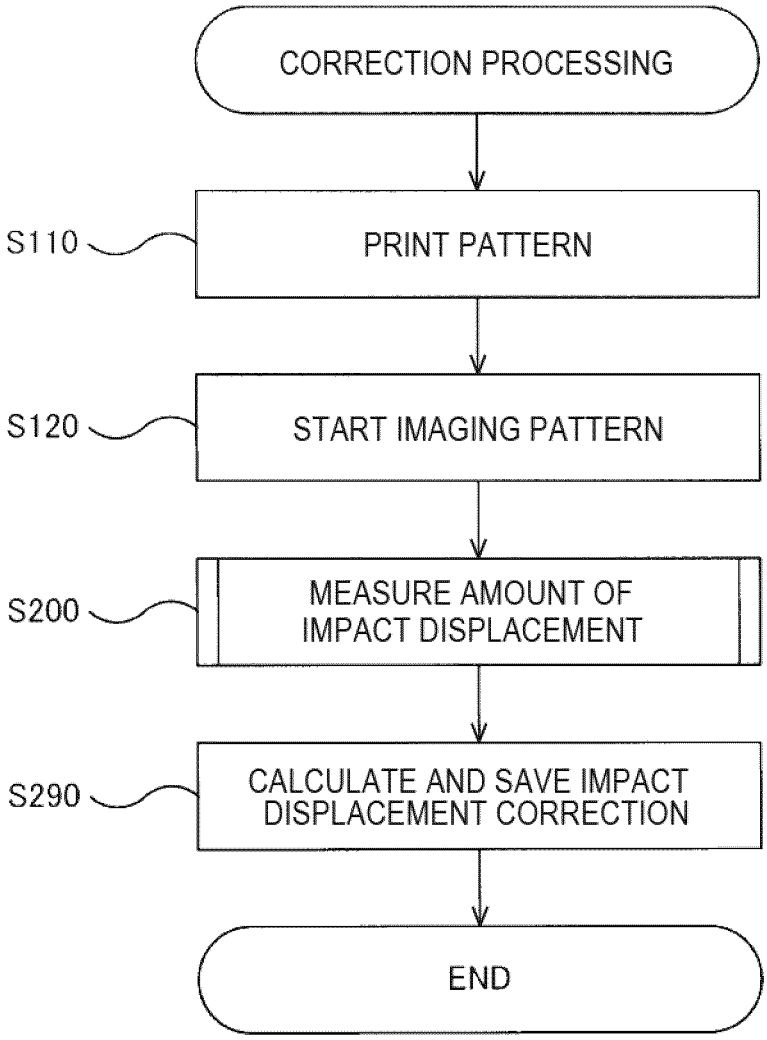
FIG. 3 is a flowchart illustrating correction processing.

FIG. 3 is a flowchart illustrating the correction processing. First, a test pattern 40 is printed on the printed medium MD (S110).

Figure 4:
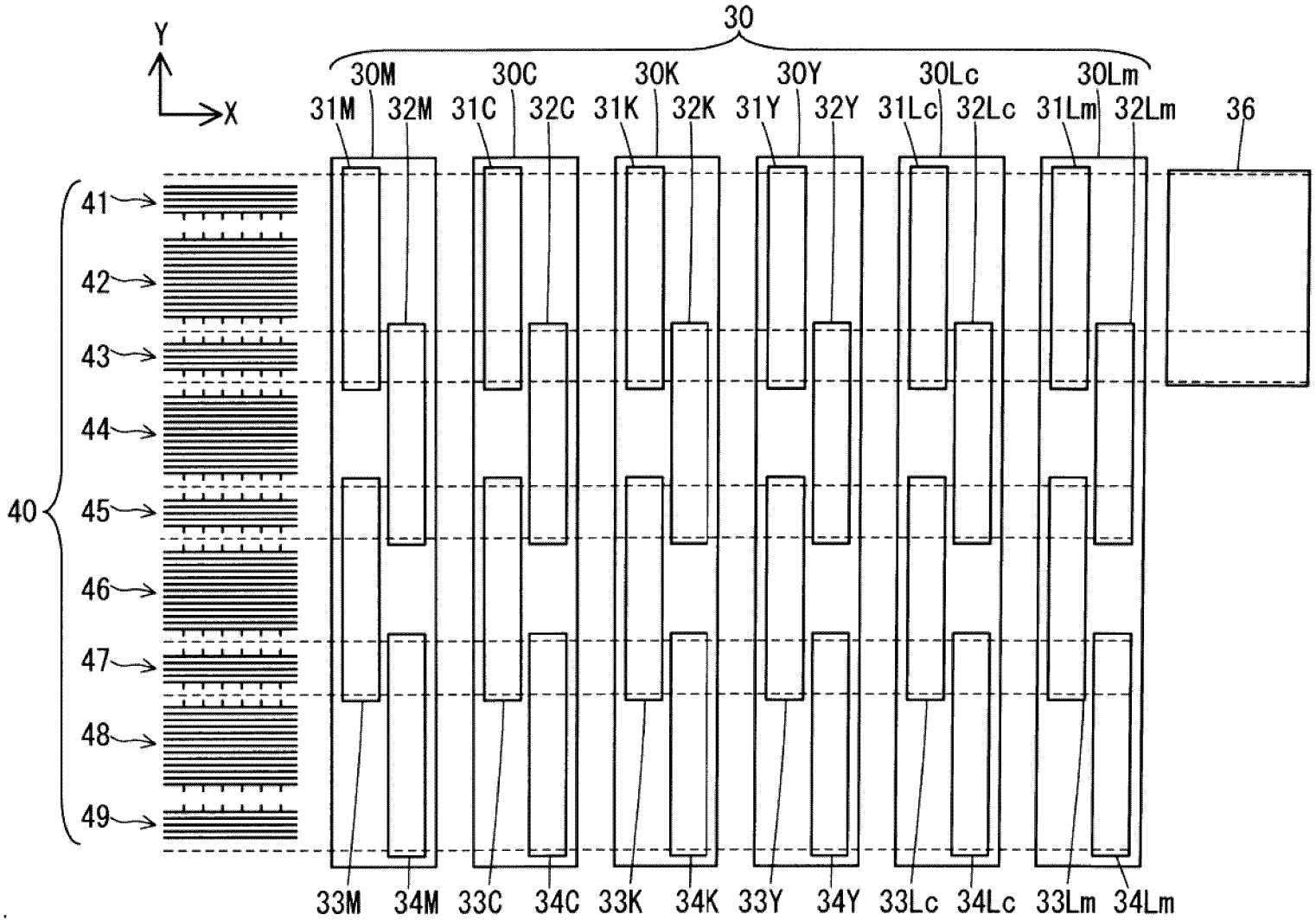
FIG. 4 is a diagram illustrating a print head set and a pattern.

FIG. 4 illustrates the print head set 30, the area sensor 36, and the test pattern 40. FIG. 4 illustrates an XY coordinate system. The X direction represents the primary scan direction. The Y direction represents the secondary scan direction. The positive side in the Y direction represents the secondary scan downstream side. Namely, the printed medium MD is transported from the lower side toward the upper side in FIG. 4.

First, explanation follows regarding the print head set 30. The print head set 30 is configured by a magenta print head 30M, a cyan print head 30C, a black print head 30K, a yellow print head 30Y, a light cyan print head 30Lc, and a light magenta print head 30Lm.

In the following explanation, the magenta print head 30M is taken as an example. With the exception of the difference in ink color, the following explanation regarding the print head is common to each of the print heads. The magenta print head 30M includes a first print tip 31M to a fourth print tip 34M.

Figure 5:
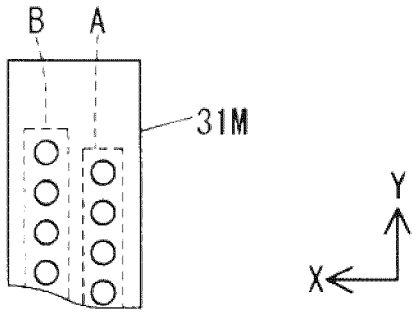
FIG. 5 is a diagram illustrating nozzles.

FIG. 5 is a diagram illustrating the first print tip 31M as viewed from the printed medium MD side. The first print tip 31M is provided with plural nozzles NZ. Ink droplets are ejected through each of the nozzles NZ.

The nozzles NZ are provided in two rows, as illustrated in FIG. 5. Of the rows formed by the nozzles, a row positioned on the X direction negative side is referred to as nozzle row A, and a row positioned on the X direction positive side is referred to as nozzle row B. The second print tip 32M to the fourth print tip 34M are each provided with nozzles configured similarly to those of the first print tip 31M.

The first print tip 31M to the fourth print tip 34M each include overlapping regions. Overlapping regions are regions in which dots can be formed by either of two different print tips mounted on the same print head. The second print tip 32M includes overlapping regions with both the first print tip 31M and the third print tip 33M. The third print tip 33M also includes an overlapping region with the fourth print tip 34M.

In the following explanation, the regions that are not overlapping regions are referred to as solitary regions. In FIG. 4, boundaries between the overlapping regions and the solitary regions are indicated by dashed lines.

The test pattern 40 is configured by a first sector 41 to a ninth sector 49. Each of the first sector 41 to the ninth sector 49 is formed at a different position in the Y direction. The pattern printed at S110 is formed entirely by a single pass. A single pass is implemented by a single primary scan in one direction only.

The second sector 42, the fourth sector 44, the sixth sector 46, and the eighth sector 48 are formed by ink ejected from nozzles contained in solitary regions. These sectors are collectively referred to below as "head sectors". The head sectors are sectors used to measure impact displacement between the print heads.

The third sector 43, the fifth sector 45, and the seventh sector 47 are formed by ink ejected from nozzles contained in overlapping regions. These sectors are collectively referred to below as "tip sectors". The tip sectors are sectors used to measure impact displacement between the print tips.

Although the first sector 41 and the ninth sector 49 also configure part of the test pattern 40, they are not used to measure impact displacement amounts. Impact displacement measurement is described in the detailed description of the test pattern 40 that follows.

Next, imaging of the pattern is started (S120). In terms of the Y direction positional relationships illustrated in FIG. 4, the first sector 41 to the third sector 43 configure an imaging range of the area sensor 36. The first sector 41 to the third sector 43 are therefore imaged first. Secondary scanning is then used in order to sequentially image the fourth sector 44 to the sixth sector 46, and the seventh sector 47 to the ninth sector 49.

After imaging of the pattern is started, once imaging of the first sector 41 to the third sector 43 has been completed, measurement of the impact displacement amount commences in parallel with imaging of the other sectors (S200).

Figure 6:
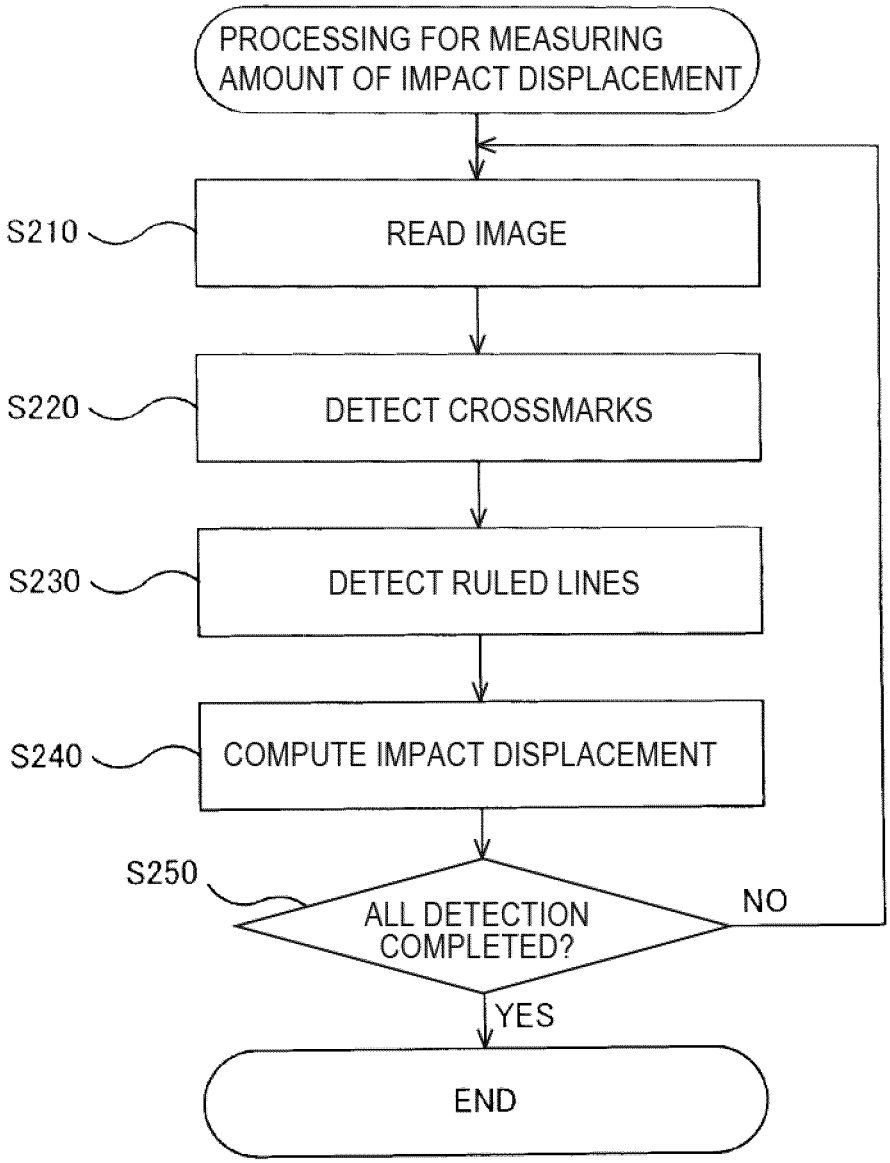
FIG. 6 is a flowchart illustrating impact displacement amount measurement processing.

FIG. 6 is a flowchart illustrating the impact displacement amount measurement processing. First, a captured image is read (S210). Then crossmarks are detected (S220). The crossmarks are described in the detailed description of the test pattern 40 that follows.

Figure 7:
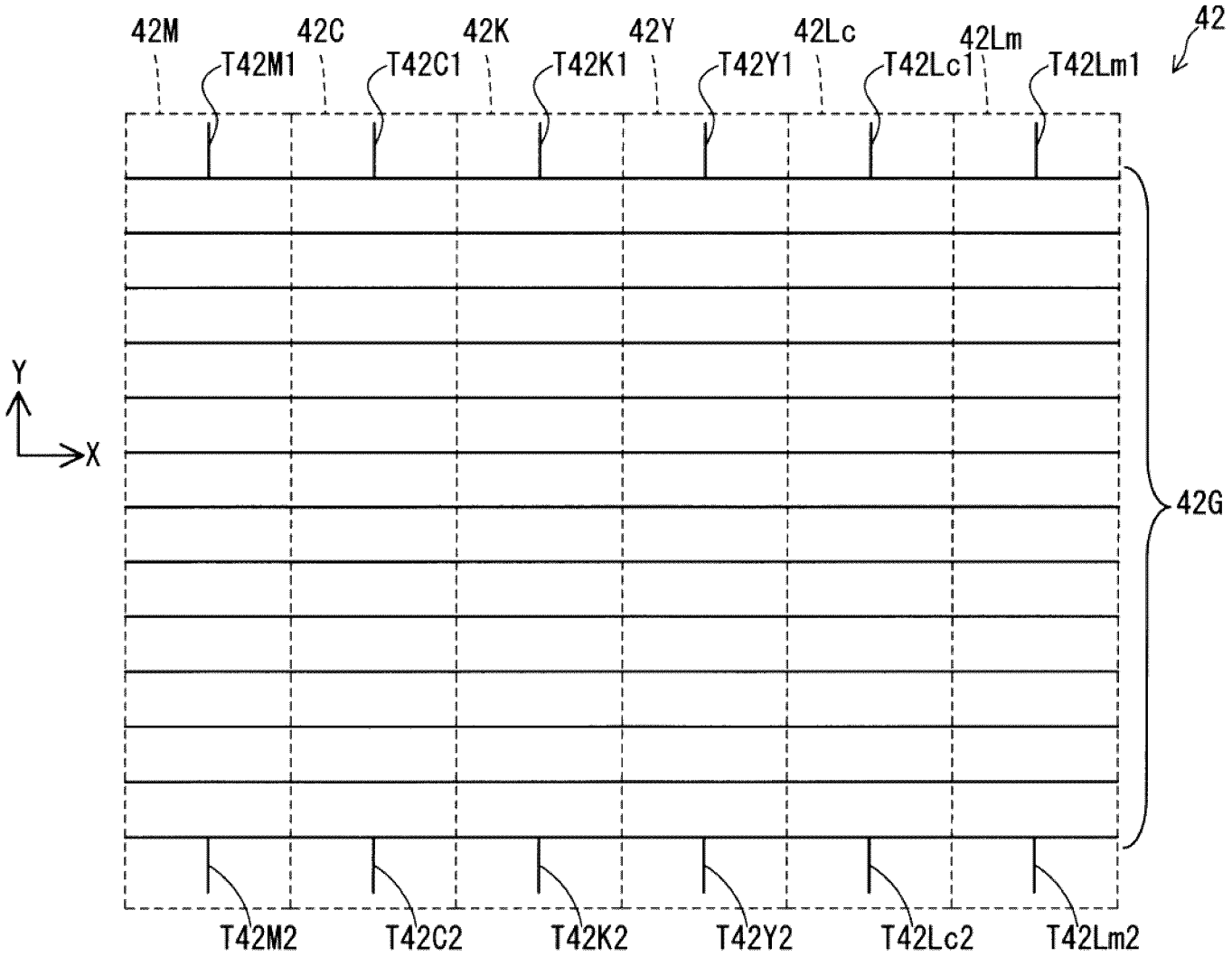
FIG. 7 is a diagram illustrating a second sector.

FIG. 7 illustrates the second sector 42. The second sector 42 is a sector used to measure the impact displacement of the first print tip mounted to each print head. Note that the fourth sector 44 is a sector used to measure impact displacement in the second print tip mounted to each print head. The sixth sector 46 is a sector used to measure impact displacement in the third print tip mounted to each print head. The eighth sector 48 is a sector used to measure impact displacement in the fourth print tip mounted to each print head.

Each of the sectors configuring the head sectors have the same characteristics as each other, with the exception of the target print tip. Explanation accordingly follows regarding the second sector 42 as a representative of the head sectors.

The second sector 42 is configured by a magenta region 42M, a cyan region 42C, a black region 42K, a yellow region 42Y, a light cyan region 42Lc, and a light magenta region 42Lm. The rectangles demarcated by dashed lines indicate hypothetical boundary lines, and are not actually printed.

The crossmarks detected in the second sector 42 are the crossmarks T42M1 to T42Lm1, and the crossmarks T42M2 to T42Lm2 illustrated in FIG. 7. Crossmark detection involves determining the approximate positions of each of the crossmarks. The "positions" referred to here are respective coordinate positions in the X direction and the Y direction.

Figure 8:
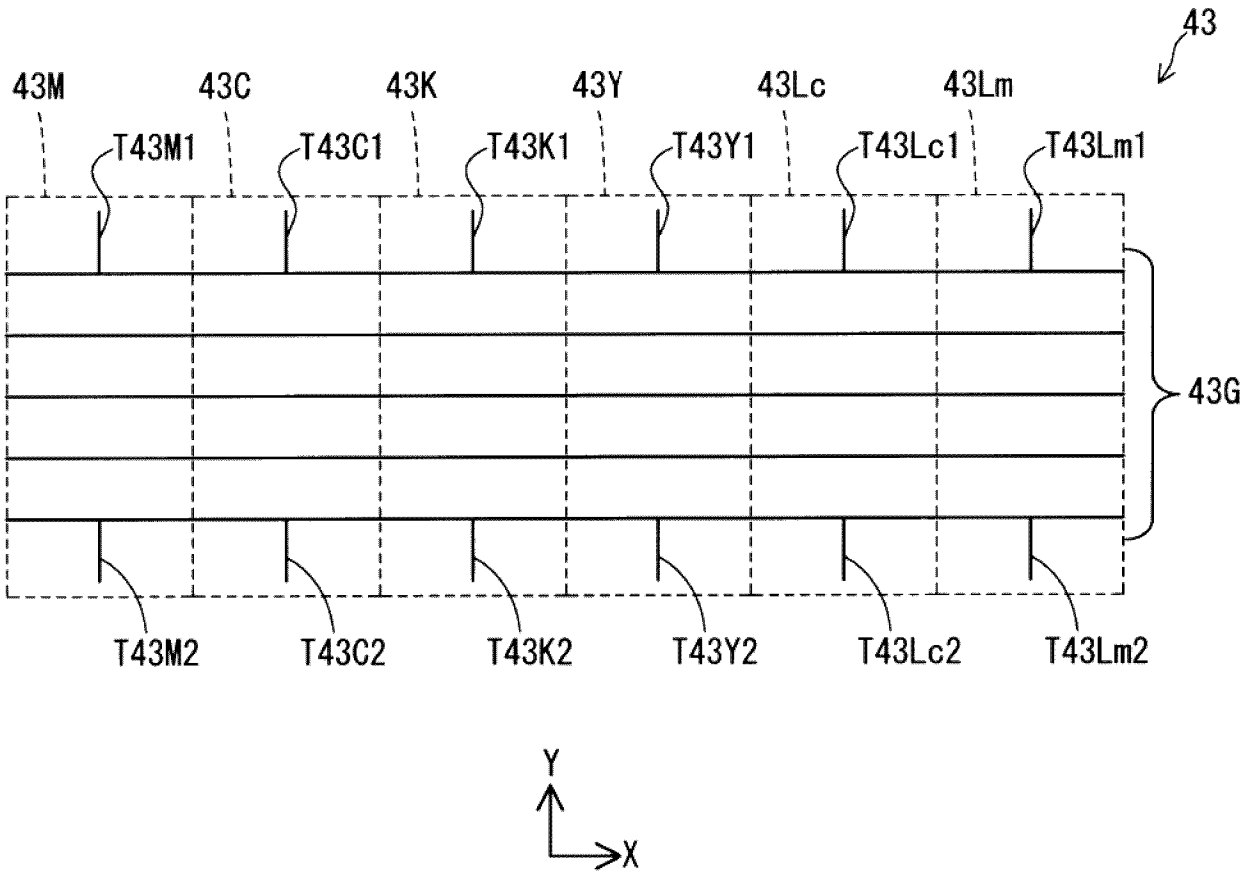
FIG. 8 is a diagram illustrating a third sector.

FIG. 8 illustrates the third sector 43. The third sector 43 is a sector used to measure impact displacement between the first print tip and the second print tip mounted to each print head. Note that the fifth sector 45 is a sector used to measure impact displacement between the second print tip and the third print tip mounted to each print head. The seventh sector 47 is a sector used to measure impact displacement between the third print tip and the fourth print tip mounted to each print head.

Each of the sectors configuring to the tip sectors have the same characteristics as each other, with the exception of the target print tips. Explanation accordingly follows regarding the third sector 43 as a representative of the tip sectors.

The third sector 43 is configured by a magenta region 43M, a cyan region 43C, a black region 43K, a yellow region 43Y, a light cyan region 43Lc, and a light magenta region 43Lm. The rectangles illustrated by dashed lines indicate hypothetical regions, and are not actually printed.

The crossmarks detected in the third sector 43 are the crossmarks T43M1 to T43Lm1, and the crossmarks T43M2 to T43Lm2 illustrated in FIG. 8.

Next, the positions of ruled lines are detected (S230). Out of the lines included in the test pattern 40, the ruled lines are the lines running in the X direction. The positions detected at S230 are positions in the Y direction. FIG. 7 illustrates ruled lines 42G, and FIG. 8 illustrates ruled lines 43G.

Figure 9:
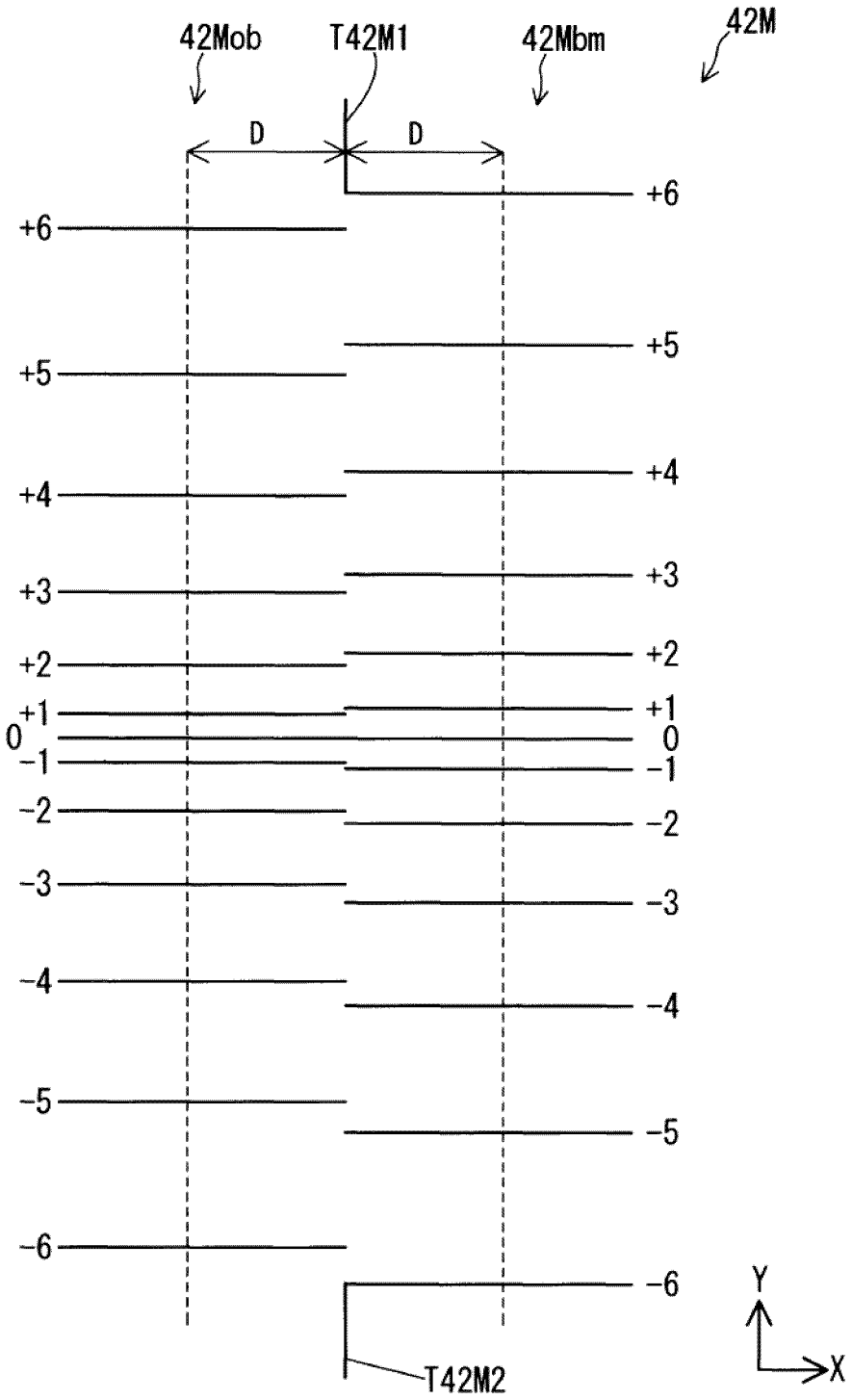
FIG. 9 is a diagram illustrating a magenta region included in a head sector in isolation.
Figure 10:
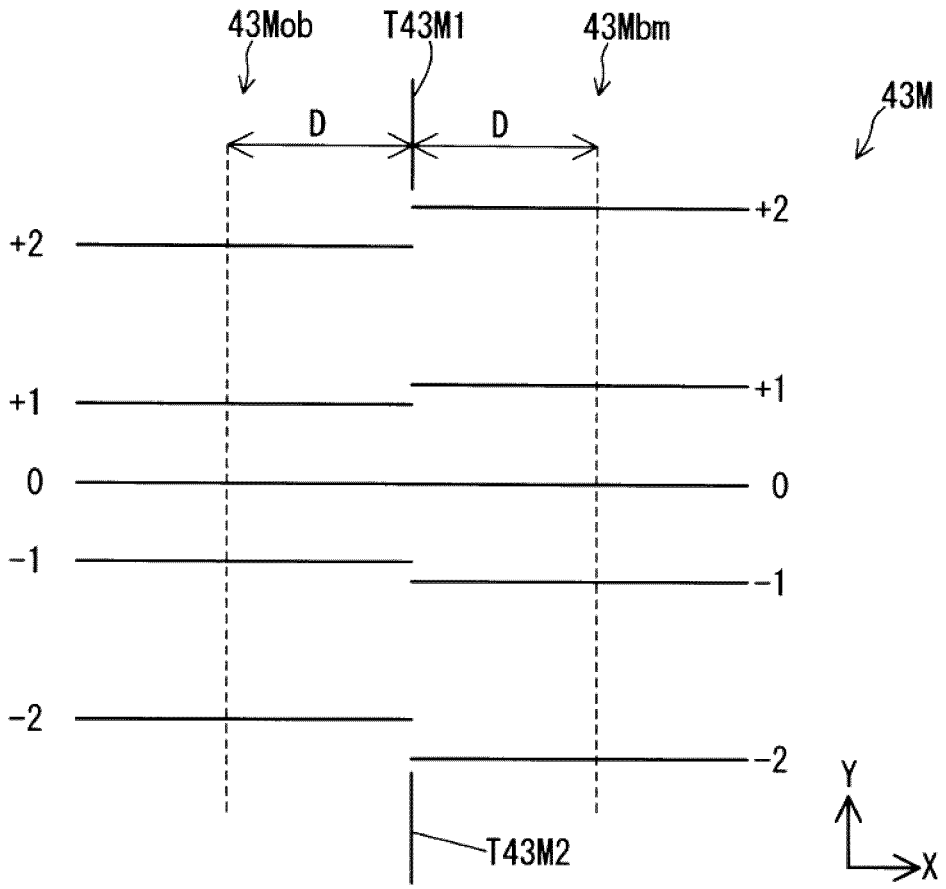
FIG. 10 is a diagram illustrating a magenta region included in a tip sector in isolation.

In the following explanation, magenta regions are taken as representatives of regions of each of the six colors of ink. FIG. 9 illustrates the magenta region 42M in isolation. FIG. 10 illustrates the magenta region 43M in isolation.

The magenta region 42M is configured by a reference ruled line set 42Mbm, a measurement ruled line set 42Mob, a crossmark T42M1, and a crossmark T42M2. Together, the reference ruled line set 42Mbm and the measurement ruled line set 42Mob form a pair.

The magenta region 43M is configured by a reference ruled line set 43Mbm, a measurement ruled line set 43Mob, a crossmark T43M1, and a crossmark T43M2. Together, the reference ruled line set 43Mbm and the measurement ruled line set 43Mob form a pair.

Detection of the positions of the ruled lines at S230 involves detecting the Y direction positions of each of the ruled lines configuring the reference ruled line set 42Mbm, and detecting the Y direction positions of each of the ruled lines configuring the measurement ruled line set 42Mob.

The values "−6" to "+6" illustrated in FIG. 9 represent impact displacement amounts, and are not actually printed. The numbers "−2" to "+2" illustrated in FIG. 10 represent impact displacement amounts, and are not actually printed. In both FIG. 9 and FIG. 10, the Y direction positions of the ruled lines with the impact displacement amount "0" (referred to below as "specified ruled lines") are aligned with each other. Namely, both FIG. 9 and FIG. 10 illustrate a state in which no impact displacement is present.

In FIG. 4, FIG. 7, and FIG. 8, the spacings between the ruled lines are illustrated as if the spacings were uniform. However, as illustrated in FIG. 9 and FIG. 10 in reality, in the present embodiment the spacings between the ruled lines are not uniform distances. Specifically, the distance between the ruled lines is determined in the following manner.

In the case of the reference ruled line set 42Mbm illustrated in FIG. 9, the distance from a ruled line with a impact displacement amount n (n being an integer from −5 to +5) to the next ruled line is expressed by the following equation. Note that out of the two ruled lines adjacent to the ruled line with the impact displacement amount n, the "next ruled line" refers to the ruled line positioned on the side further away from the specified ruled line. Note that when n=0, the ruled line with the impact displacement amount n is the specified ruled line, and as such, the next ruled line cannot be defined in the manner described above. However, in the present embodiment, when n=0, the distance is the same whether the next ruled line is the ruled line for the impact displacement amount "−1" or the ruled line for the impact displacement amount "+1", and so either the ruled line for the impact displacement amount "−1" or the ruled line for the impact displacement amount "+1" may be considered to be the next ruled line.

$$Dbm(n)=|n|\times a \qquad \text{Equation (1)}$$

In the above Equation, a is a constant greater than zero. From the above Equation, it can be seen that the distance between the ruled lines of the reference ruled line set 42Mbm increases the further from the specified ruled line. The method for determining the distance between the ruled lines using Equation (1) is common to each of the head sectors.

In the reference ruled line set 42Mbm, the position of a ruled line with a impact displacement amount n' (n' being an integer from −6 to +6) as referenced against the specified ruled line is expressed by the following equation.

$$Ebm(n')=n'a(|n'|+1)/2 \qquad \text{Equation (2)}$$

On the other hand, in the case of the measurement ruled line set 42Mob, the position of a ruled line with a impact displacement amount n' (n' being an integer from −6 to +6) as referenced against the specified ruled line is expressed by the following equation.

$$Eob(n')=n'[\{a(|n'|+1)/2\}-b] \qquad \text{Equation (3)}$$

In Equation (3), b is a constant satisfying $0<b<a/2$. According to Equation (3) and with $b<a/2$, the distance between the ruled lines of the reference ruled line set 42Mbm increases the further from the specified ruled line. The method for determining the distance between the ruled lines using Equation (3) is common to each of the head sectors.

In the case of the reference ruled line set 43Mbm illustrated in FIG. 10, the distance Dbm (n) from the ruled line with the impact displacement amount n to the next ruled line, and the position of the ruled line with the impact displacement amount n' as referenced against the specified ruled line, can be expressed by Equations (1) to (3), similarly to for the head sectors. Accordingly, the distance between the ruled lines of the measurement ruled line set 42Mob increases the further from the specified ruled line, and the distance between the ruled lines of the reference ruled line set 42Mbm also increases the further from the specified ruled line. Note that n is substituted for an integer from −1 to +1, and n' is substituted for an integer from −2 to +2. The values of the constants a and b may be the same as those used for the head sectors, or may be changed.

The impact displacement resulting from head misalignment between the print heads refers to Y direction impact displacement when referenced against a landing position of a reference print head. In the present embodiment, the print head that is replaced infrequently is selected as the reference print head. For example, the present embodiment assumes that the cyan print head 30C is selected. Accordingly, all of the reference ruled line sets of the head sectors are formed using cyan ink. Out of the six colors in the present embodiment, the cyan ink is used the least frequently. Note that selection of the reference print head is not limited to that described in the present embodiment, and, for example, a head that is replaced frequently, or a color that produces easy-to-detect ruled line positions may be selected.

The measurement ruled line set of each head sector is formed using ink ejected from the print head to be measured. For example, the measurement ruled line set 42Mob is formed using magenta ink. Note that any of the crossmarks may be formed using any ink color. In the present embodiment, the crossmarks are formed using black ink.

In the tip sectors, each region is employed in order to measure impact displacement resulting from tip misalignment between the print tips in the overlapping regions. Accordingly, in the tip sectors, the respective pairs of reference ruled line sets and the measurement ruled line sets are formed using the same ink color. For example, the measurement ruled line set 43Mob and the reference ruled line set 43Mbm are both formed using magenta ink.

In each tip sector, the reference ruled line set is formed using a print tip at a downstream side position in the transport direction of the printed medium MD. Moreover, in each tip sector, the measurement ruled line set is formed using a print tip at an upstream side position in the transport direction of the printed medium MD. For example, the reference ruled line set 43Mbm is formed by the first print tip 31M, and the measurement ruled line set 43Mob is formed by the second print tip 32M.

Detection of the ruled lines at S230 is performed using the crossmarks in each region. For example, when employing the crossmark T42M1 and the crossmark T42M2, changes in radiance along the Y direction are detected at respective positions offset by a predetermined length D to the X direction positive side and the X direction negative side of the crossmark T42M1 and the crossmark T42M2. This thereby enables detection of the Y direction positions of the respective lines configuring the ruled lines 42G. The predetermined length D is set to a length equivalent to half the X direction length of the ruled lines.

Next, the impact displacement amount is computed (S240). In the present embodiment, one of the ruled lines in the measurement ruled line set is considered to have the same Y direction position as one ruled line in the reference ruled line set.

Next, determination is made as to whether or not all detection has been completed (S250). Namely, determination is made as to whether or not computation of the impact displacement amount has been completed for the sectors of each color for each of the second sector 42 to the eighth sector 48.

In cases in which detection has not been completed (S250=NO), S210 to S240 are repeated as appropriate. In cases in which all detection has been completed, (S250=YES), the impact displacement amount measurement processing is ended.

When the impact displacement amount measurement processing has been ended, impact displacement correction calculation is executed (S290), and then the correction processing is ended. When the correction processing has been ended, dot formation processing is executed (S300).

Figure 11:
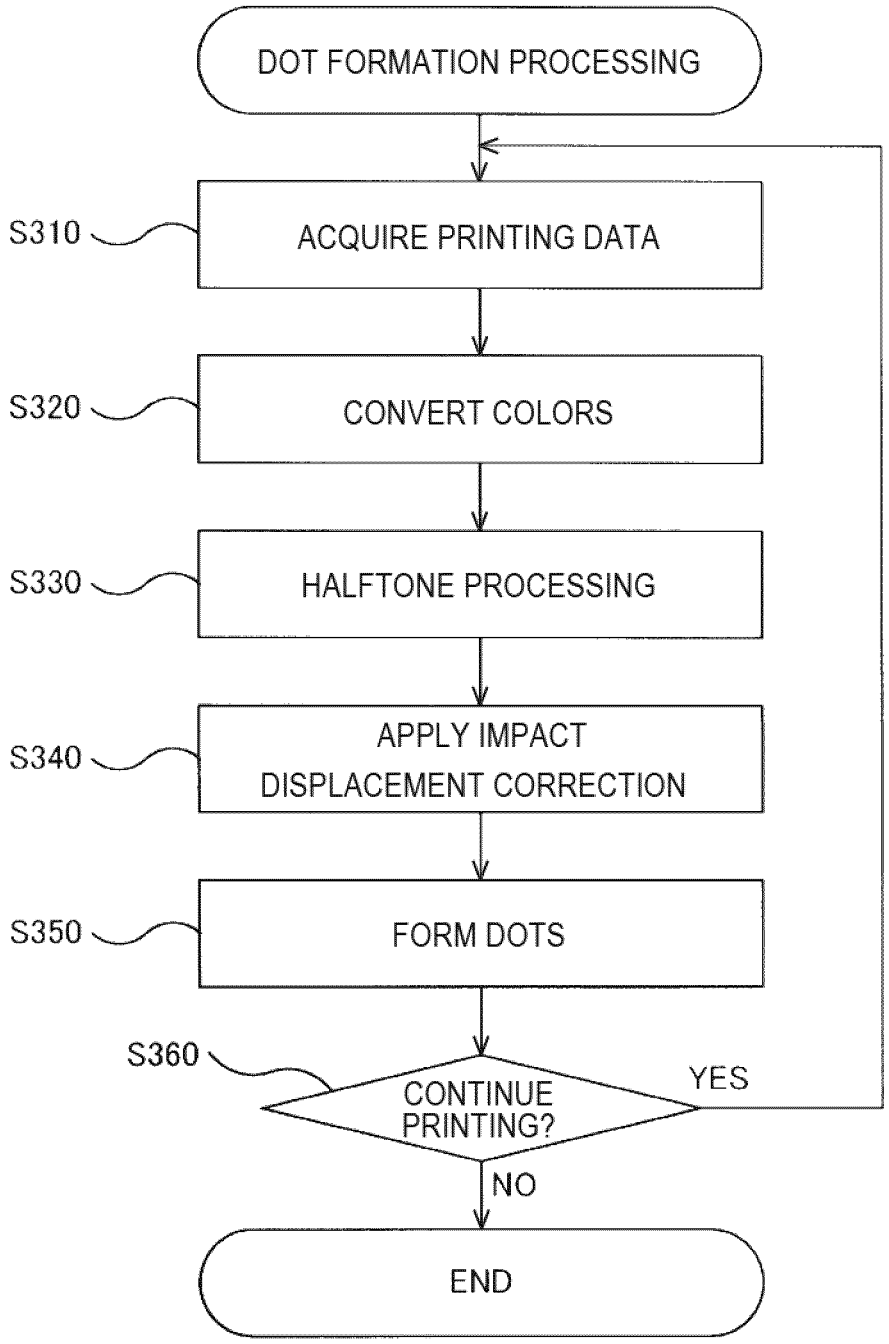
FIG. 11 is a flowchart illustrating dot formation processing.

FIG. 11 is a flowchart illustrating dot formation processing. First, printing data to be printed is acquired (S310). Next, color conversion is executed (S320). Namely, printing data expressed in RGB is converted to ink values using the CMYKLcLm color system. Next, halftone processing is executed (S330).

The impact displacement correction is then applied (S340). Namely, dot data obtained by the halftone processing is corrected using the impact displacement correction saved at S290.

Next, dots are formed using the corrected dot data (S350). When dot formation based on the printing data acquired at S310 has been completed, determination is made as to whether or not to continue printing (S360). In cases in which printing is to be continued (S360=YES), processing returns to S310. In cases in which printing is to be ended (S360=NO), the dot formation processing is ended. Accompanying this, printing processing is also ended.

The above embodiment facilitates detection of which of the impact displacement amount ruled lines are aligned, even if the area used for creating the test pattern 40 is made smaller and the ruled lines are tightly packed in the Y direction. The distance between the ruled lines in the reference ruled line set and the measurement ruled line set increases the further from the specified ruled line.

The present disclosure is not limited to the embodiments, examples, and modified examples of the present specification, and various configurations may be implemented within a range that does not depart from the spirit of the present disclosure. For example, appropriate substitutions or combinations may be made to the technical features in the embodiments, examples, and modified examples corresponding to the technical features described in the aspects in the "Summary" section, in order to address some or all of the issues described above, or in order to achieve some or all of the advantageous effects described above. Technical features not indicated to be essential in the present specification may be omitted as appropriate. See, for example, the following examples.

Any modification may be made, as long as the distance between the ruled lines in the reference ruled line set and the distance between the ruled lines in measurement ruled line set increase the further from the specified ruled line.

The test pattern may be configured with either the head sectors or the tip sectors omitted.

Any ink color may be employed as the ink color used to create the test pattern, and may, for example, a single color may be employed.

It is sufficient that the position where the area sensor 36 is provided be a position capable of reading the test pattern, and the area sensor 36 may be provided to a configuration other than the carriage 25.

In the embodiment described above, some or all of the functions and processing implemented using software may be implemented by hardware. Moreover, some or all of the functions and processing implemented using hardware may be implemented by software. Various circuits may be employed as hardware: for example integrated circuits, discrete circuits, or circuit modules configured by a combination of such circuits.

This application claims priority under 35 U.S.C. § 119 to Japanese Patent Application No. 2017-029920, filed Feb. 21, 2017. The entire disclosure of Japanese Patent Application No. 2017-029920 is hereby incorporated herein by reference.

What is claimed is:

1. A test pattern creation method comprising:

providing a carriage comprising a plurality of print heads arrayed in a primary scan direction, wherein the plurality of print heads includes a first print head comprising a first set of nozzles configured to form dots of a first ink color, and a second print head comprising a second set of nozzles configured to form dots of a second ink color;

creating a test pattern to measure impact displacement in a secondary scan direction by performing steps comprising:

creating a reference ruled line set by ejecting ink from the first set of nozzles, wherein the reference ruled line set includes a plurality of reference ruled lines running in the primary scan direction, and creating a measurement ruled line set by ejecting ink from the second set of nozzles, wherein the measurement ruled line set includes a plurality of measurement ruled lines running in the primary scan direction;

wherein a specified ruled line in the reference ruled line set and a specified ruled line in the measurement ruled line set have positions that are aligned in the secondary scan direction when no impact displacement is present in the secondary scan direction;

wherein spacings between the ruled lines within the reference ruled line set progressively increase in the secondary scan direction away from the specified ruled line in the reference ruled line set, on both an upstream side of the specified ruled line in the reference ruled line set and a downstream side of the specified ruled line in the reference ruled line set;

wherein spacings between the ruled lines within the measurement ruled line set progressively increase in the secondary scan direction away from the specified ruled line in the measurement ruled line set, on both an upstream side of the specified ruled line in the measurement ruled line set and a downstream side of the specified ruled line in the measurement ruled line set; and wherein a spacing between any two ruled lines within the reference ruled line set is different from a corresponding spacing between corresponding ruled lines within the measurement ruled line set.

2. The test pattern creation method according to claim 1, wherein:

the first print head comprises a third set of nozzles configured to form dots of the first ink color;

the reference ruled line set is a first reference ruled line set;

the measurement ruled line set is a first measurement ruled line set; and the specified ruled lines are first specified ruled lines;

the step of creating the test pattern further comprises:

creating a second reference ruled line set using the first set of nozzles;

creating a second measurement ruled line set by ejecting ink from the third set of nozzles;

wherein a second specified ruled line in the second reference ruled line set and a second specified ruled line in the second measurement ruled line set have positions that are aligned in the secondary scan direction when no impact displacement is present in the secondary scan direction;

wherein spacings between the ruled lines within the second reference ruled line set progressively increase in the secondary scan direction away from the second specified ruled line in the second reference ruled line set, on both an upstream side of the second specified ruled line in the second reference ruled line set and a downstream side of the second specified ruled line in the second reference ruled line set; and wherein spacings between the ruled lines within the second measurement ruled line set progressively increase in the secondary scan direction away from the second specified ruled line in the measurement ruled line set, on both an upstream side of the second specified ruled line in the second measurement ruled line set and a downstream side of the second specified ruled line in the second measurement ruled line set.

3. The test pattern creation method according to claim 2, wherein:

in the secondary scan direction, a position at which the first reference ruled line set is formed is different from a position at which the second reference ruled line set is formed; and in the secondary scan direction, a position at which the first measurement ruled line set is formed is different from a position at which the second measurement ruled line set is formed.

4. The test pattern creation method according to claim 1, wherein:

the plurality of print heads includes a third print head comprising a third set of nozzles configured to form dots of a third ink color;

the test pattern includes at least two ruled line set pairs in which the reference ruled line set and the measurement ruled line set are created using sets of nozzles of different print heads;

the step of creating the test pattern further comprises further comprises forming a measurement ruled line set within a different ruled line set pair than the ruled line set pair containing the measurement ruled line set created using the second set of nozzles by using the third set of nozzles; and a usage frequency of the first ink color is lower than both a usage frequency of the second ink color and a usage frequency of the third ink color.

5. A printing apparatus comprising:

a carriage comprising a plurality of print heads arrayed in a primary scan direction, wherein the plurality of print heads includes a first print head comprising a first set of nozzles configured to form dots of a first ink color, and a second print head comprising a second set of nozzles configured to form dots of a second ink color;

a controller configured to control the carriage to create a test pattern to measure impact displacement in a secondary scan direction by performing steps comprising:

creating a reference ruled line set by ejecting ink from the first set of nozzles, wherein the reference ruled line set includes a plurality of reference ruled lines running in the primary scan direction, and creating a measurement ruled line set by ejecting ink from the second set of nozzles, wherein the measurement ruled line set includes a plurality of measurement ruled lines running in the primary scan direction;

wherein a specified ruled line in the reference ruled line set and a specified ruled line in the measurement ruled line set have positions that are aligned in the secondary scan direction when no impact displacement is present in the secondary scan direction;

wherein spacings between the ruled lines within the reference ruled line set progressively increase in the secondary scan direction away from the specified ruled line in the reference ruled line set, on both an upstream side of the specified ruled line in the reference ruled line set and a downstream side of the specified ruled line in the reference ruled line set;

wherein spacings between the ruled lines within the measurement ruled line set progressively increase in the secondary scan direction away from the specified ruled line in the measurement ruled line set, on both an upstream side of the specified ruled line in the measurement ruled line set and a downstream side of the specified ruled line in the measurement ruled line set; and wherein a spacing between any two ruled lines within the reference ruled line set is different from a corresponding spacing between corresponding ruled lines within the measurement ruled line set.

6. A non-transient computer-readable medium comprising a program to control a printing apparatus comprising a carriage comprising a plurality of print heads arrayed in a primary scan direction, wherein the plurality of print heads includes a first print head comprising a first set of nozzles configured to form dots of a first ink color, and a second print head comprising a second set of nozzles configured to form dots of a second ink color, wherein the program, when executed, causes the printing apparatus to perform steps comprising:

creating a test pattern to measure impact displacement in a secondary scan direction by performing steps comprising:

creating a reference ruled line set by ejecting ink from the first set of nozzles, wherein the reference ruled line set includes a plurality of reference ruled lines running in the primary scan direction, and creating a measurement ruled line set by ejecting ink from the second set of nozzles, wherein the measurement ruled line set includes a plurality of measurement ruled lines running in the primary scan direction;

wherein a specified ruled line in the reference ruled line set and a specified ruled line in the measurement ruled line set have positions that are aligned in the secondary scan direction when no impact displacement is present in the secondary scan direction;

wherein spacings between the ruled lines within the reference ruled line set progressively increase in the secondary scan direction away from the specified ruled line in the reference ruled line set, on both an upstream side of the specified ruled line in the reference ruled line set and a downstream side of the specified ruled line in the reference ruled line set;

wherein spacings between the ruled lines within the measurement ruled line set progressively increase in the secondary scan direction away from the specified ruled line in the measurement ruled line set, on both an upstream side of the specified ruled line in the measurement ruled line set and a downstream side of the specified ruled line in the measurement ruled line set; and wherein a spacing between any two ruled lines within the reference ruled line set is different from a corresponding spacing between corresponding ruled lines within the measurement ruled line set.

* * * * *